US007832905B2

(12) United States Patent
Kittelmann et al.

(10) Patent No.: US 7,832,905 B2
(45) Date of Patent: Nov. 16, 2010

(54) REFLECTOR FOR GAS DISCHARGE LAMPS

(75) Inventors: Rüdiger Kittelmann, Einbeck (DE); Harry Wagener, Alfeld (DE)

(73) Assignee: Auer Lighting GmbH (DE)

( * ) Notice: Subject to any disclaimer, the term of this patent is extended or adjusted under 35 U.S.C. 154(b) by 193 days.

(21) Appl. No.: 11/834,461

(22) Filed: Aug. 6, 2007

(65) Prior Publication Data

US 2008/0055912 A1 Mar. 6, 2008

(30) Foreign Application Priority Data

Aug. 15, 2006 (DE) ..... 10 2006 038 382

(51) Int. Cl.
*F21V 7/00* (2006.01)

(52) U.S. Cl. ..... 362/296.07; 362/296.01; 362/341; 362/346; 362/517; 362/343

(58) Field of Classification Search ..... 362/343, 362/341, 348, 349, 350, 346, 297, 296.01, 362/516, 517, 509, 514; 313/483, 484
See application file for complete search history.

(56) References Cited

U.S. PATENT DOCUMENTS 1,516,379 A * 11/1924 Dufek ..... 362/348
5,272,408 A 12/1993 Levin et al.
6,867,544 B2 * 3/2005 Takahashi et al. ..... 313/574
7,090,383 B2 * 8/2006 Kondo et al. ..... 362/518
7,417,375 B2 * 8/2008 Muto et al. ..... 313/638

FOREIGN PATENT DOCUMENTS

| | | | |
|---|---|---|---|
| DE | 199 05 115 | A1 | 8/2000 |
| DE | 102 29 012 | A1 | 1/2004 |
| EP | 0 250 191 | A2 | 12/1987 |
| EP | 0 985 870 | A2 | 3/2000 |
| WO | 9945314 | A1 | 9/1999 |

OTHER PUBLICATIONS

Christian Lange, "EP Application No. EP 07 01 5079 Search Report", Nov. 2, 2007, Publisher: EPO, Published in: EPO.

* cited by examiner

*Primary Examiner*—Anabel M Ton
(74) *Attorney, Agent, or Firm*—DeMont & Breyer, LLC

(57) ABSTRACT

The invention relates to a reflector, in particular for discharge luminaires, in the case of which at least two facets direct the light from an upper and a lower region of the discharge lamp in the same direction.

28 Claims, 3 Drawing Sheets

REFLECTOR FOR GAS DISCHARGE LAMPS

FIELD OF THE INVENTION

The invention relates to a reflector, in particular configured for use with gas discharge lamps.

BACKGROUND OF THE INVENTION

Reflectors for holding luminous means are known. In particular, faceted reflectors are known in numerous embodiments.

Thus, for example, German Patent Specification DE 199 10 192 C2 (inventors: Rüdiger Kittelmann, Harry Wagener) exhibits a faceted reflector with a rotationally symmetrical basic body, in the case of which intensity inhomogeneities of the luminous means that lead to a rotated light field can be corrected via the arrangement of the facets. Reference is made in full to the disclosure content of this patent specification.

In addition to inhomogeneities in the illuminance that are caused by an inhomogeneous emission by the light source, it has emerged that inhomogeneities can also arise in the luminous color, particularly for specific luminous means.

The problem relates to discharge lamps, in particular.

Reference is made by way of example to metal halide lamps with ceramic burner from the supplier Osram, that are marketed under the product designations of POWERBALL HCI and POWERSTAR HCI. Such lamps are supplied with a color temperature of 3000 and 4200 kelvin.

Metal and gaseous additives are used in order to adapt the luminous color, in particular to reduce the color temperature.

It has emerged that a partial separation of the gases can come about during the operation of such lamps. As a consequence of this separation, there is a stratification leading to the fact that the lamp does not emit with a uniform color temperature but that rather, for example, regions with a slight red or green tinge occur in an upper and a lower region of the emission region which is located between the tubelectrodes.

If the emitted light of such a lamp is now imaged by a conventional faceted reflector, the result of this is that the inhomogeneities of the luminous color are imaged by the reflector. Slight discolorations of the light field, at least in some regions of the light field, are the consequence.

OBJECT OF THE INVENTION

By contrast, the object of the invention is to reduce the above described disadvantages of the prior art.

In particular, it is an object of the invention to provide a reflector that generates a light field of homogeneous luminous color even in combination with a gas discharge lamp, in particular a metal-halide lamp with ceramic burner.

It is also an object of the invention to provide a reflector that has a high efficiency and in the case of which the light intensity is also distributed as homogeneously as possible.

It is also an object of the invention to achieve as uniform a luminous color as possible even solely by means of the reflector, it being possible as a result to largely dispense with diffusers.

SUMMARY OF THE INVENTION

The object of the invention is achieved simply by a reflector for holding a luminous means, and by a luminaire as claimed in one of the independent claims.

Preferred embodiments and developments of the invention are to be gathered from the respective subclaims.

Accordingly, a reflector is provided that is configured for holding a luminous means. In particular, the reflector is designed for holding a discharge lamp such as, for example, a metal-halide lamp with a ceramic burner.

The reflector has facets. Facets are understood to be individual, typically periodically arranged, reflecting segments. These need not necessarily be sharply delimited surfaces—rather, the facets can also merge continuously into one another. The facets can assume the most varied geometric shapes, the aim below being to go further into particularly advantageous refinements.

In accordance with the invention, at least two facets of the reflector are designed in such a way that they direct light from a lower and an upper region of the emission region of the luminous means substantially in the same direction, in such a way that the light from the lower region and the upper region mixes on the illumination field. Light of the upper region and light of the lower region are therefore superposed at the illumination site.

The emission region is understood as the region from which the light of the luminous means is emitted. Thus, in the case of an incandescent lamp, the incandescent filament is understood as the emission region, whereas in the case of a gas discharge lamp the emission region is defined as the region that is arranged between the electrodes between which the gas discharge takes place. By way of example, in the case of a metal-halide lamp with a ceramic burner this is the region inside the ceramic burner.

The upper and lower regions of the emission region are defined as subregions of the volume in which the light production takes place, these being spaced apart from one another inside the entire emission region.

If now, from at least two facets of the reflector, light from two different regions of the emission region, specifically an upper and a lower region, is substantially directed in the same direction, the emitted light beams of the two regions are superposed on one another on the illumination field. Mixing of the light of two emission regions comes about. Consequently, a luminaire can be provided in the case of which a light field where inhomogeneities of the color are largely compensated is produced even for luminous means with an inhomogeneous color temperature.

In a preferred embodiment of the invention, the upper and lower emission regions are spaced apart from one another by at least 0.2, preferably 0.5 and with particular preference at least 1 mm. In this context, a region is understood as a delimited volume of the entire emission region. From a purely mathematical point of view, it is possible in principle for the upper and the lower emission regions to be reduced to a point in each case.

The upper and lower emission regions can also be distinguished in that they emit light of another color. For example, one region can emit light with a slight green tinge, and another region light with a slight red tinge. This emission of different colors is based, in particular, on a stratification of the gas mixture from a gas discharge lamp.

In a particular embodiment of the invention, the reflector has at least two types of variously configured facets that are substantially arranged in columns emanating radially from a midpoint of the reflector. At the same time, the facets run substantially circularly or elliptically about the midpoint of the reflector, and thus form rows, the cut surfaces of the rows and the columns defining fields.

In this context, as well, it is self-evident that the facets need not be sharply delimited from one another: in particular, the facets can be arranged offset from one another.

The reflector is configured in such a way that, seen from an arbitrary reference facet, a substantially identically configured facet is respectively arranged on the neighboring row and/or column in a fashion offset by at least one field.

By way of example, an identically configured facet is understood, specifically, as a facet with the same radius of curvature.

It has emerged that such an arrangement, in which the identically configured facets run spirally along the inner surface of the reflector, causes the emitted light of the light source to be rotated in such a way that the imaged light field has an exceptionally homogeneous color perception.

Alternatively, it is provided for the facets to be configured and/or arranged in a statistically random fashion.

Inhomogeneities in the luminous colors of the imaged light field can likewise be reduced via facets that have, for example, a randomly distributed radius of curvature.

In a development of the first design variant of the invention, identically configured facets are arranged offset by two fields in the manner of a knight's move. In the case of further embodiments, offsetting of the facet by three or more fields is also provided. The facets are preferably offset in this case in the neighboring row.

Identically configured, offset facets preferably run from a first row, near the midpoint, up to a second row, substantially on the edge side. Identically configured facets thus run substantially spirally from inside to outside.

In a preferred embodiment of the invention, cylindrical and/or spherical facets are used as facets.

Cylindrical facets are understood as facets that substantially have the geometry of a circular cylindrical section, while spherical facets are substantially configured as spheres.

The cylindrical facets are preferably designed in this case with their axis of rotation in the direction of the reflector midpoint and/or with their axis of rotation perpendicular to the midpoint of the reflector.

The reflector is preferably of substantially rotationally symmetrical design. Spherical, parabolic or ellipsoidal reflectors, in particular, are provided.

The radius of the basic body of the facets, in particular the spherical or cylindrical facets preferably lies between 5 mm and 200 mm. It is provided to use facets with various radii, the radius of the largest facet being at least three, preferably five and with particular preference ten times as large as the radius of the smallest facet.

Facets of these various radii are preferably distributed in a row or column.

The number of the facets in this case remains preferably constant from row to row. The facets thus become narrower toward the center, there being no intention to understand this reduction in the width of the facet as a different type of configuration of the facet in the meaning of the application.

The reflector preferably has between 5 and 30 and with particular preference between 10 and 20 rows.

Furthermore, the reflector preferably has between 20 and 150, with particular preference between 40 and 100 columns.

In the case of a particular embodiment of the invention, a spiral arrangement of identically configured facets is provided over at least 5, preferably at least 10 and with particular preference at least 15 consecutive rows or columns. With particular preference, the spiral configuration extends substantially from the center to the edge of the reflector.

In a development of the invention, the reflector is subdivided into angular regions in which the radius of curvature of the facets periodically increases and decreases. It is, in particular, provided to lower the radius of curvature from a maximum to a minimum, via a sinusoidal function, and then to cause it to rise to a maximum again.

The spacing from a maximum to the following minimum is preferably 45° or 90° in this case.

The radius of curvature of the facets therefore has four maxima within a row of the reflector given an angle of 45°.

Furthermore, the invention relates to a luminaire that is provided with an inventive reflector and has a luminous means. The luminous means is preferably installed in a holder of the reflector.

A gas discharge lamp, in particular a metal-halide lamp with ceramic burner, is preferably used as luminous means. Suitable ceramic-based discharge lamps are, in particular, luminous means from OSRAM which are marketed under the designation of OSRAM POWERBALL HCI. In particular, luminous means of product designation HCI-T35/942 NDL or HC1-T35/830 WL can be used in this case.

The color temperature of the luminous means preferably lies between 2800 and 4500 kelvin, with particular preference between 2900 and 3200 kelvin. However, it is also envisaged within the meaning of the invention to provide lamps with a higher color temperature, for example 4500 to 7000 kelvin, for example as daylight lamp.

For the purpose of further homogenizing the light field, the luminaire can have an additional diffuser, or be provided with a plate as shatter protection.

In a further preferred embodiment of the invention, the light source is over 2 cm, preferably over 3 cm and with particular preference over 5 cm long.

The length of the light source is not understood as the length of the previously defined emission region, but the length of the glass bulb in which the burner or the incandescent filament is arranged.

BRIEF DESCRIPTION OF THE DRAWING

The invention is to be explained below with the aid of the drawings, specifically FIG. 1 to FIG. 3.

DETAILED DESCRIPTION OF THE DRAWING

Figure 1:
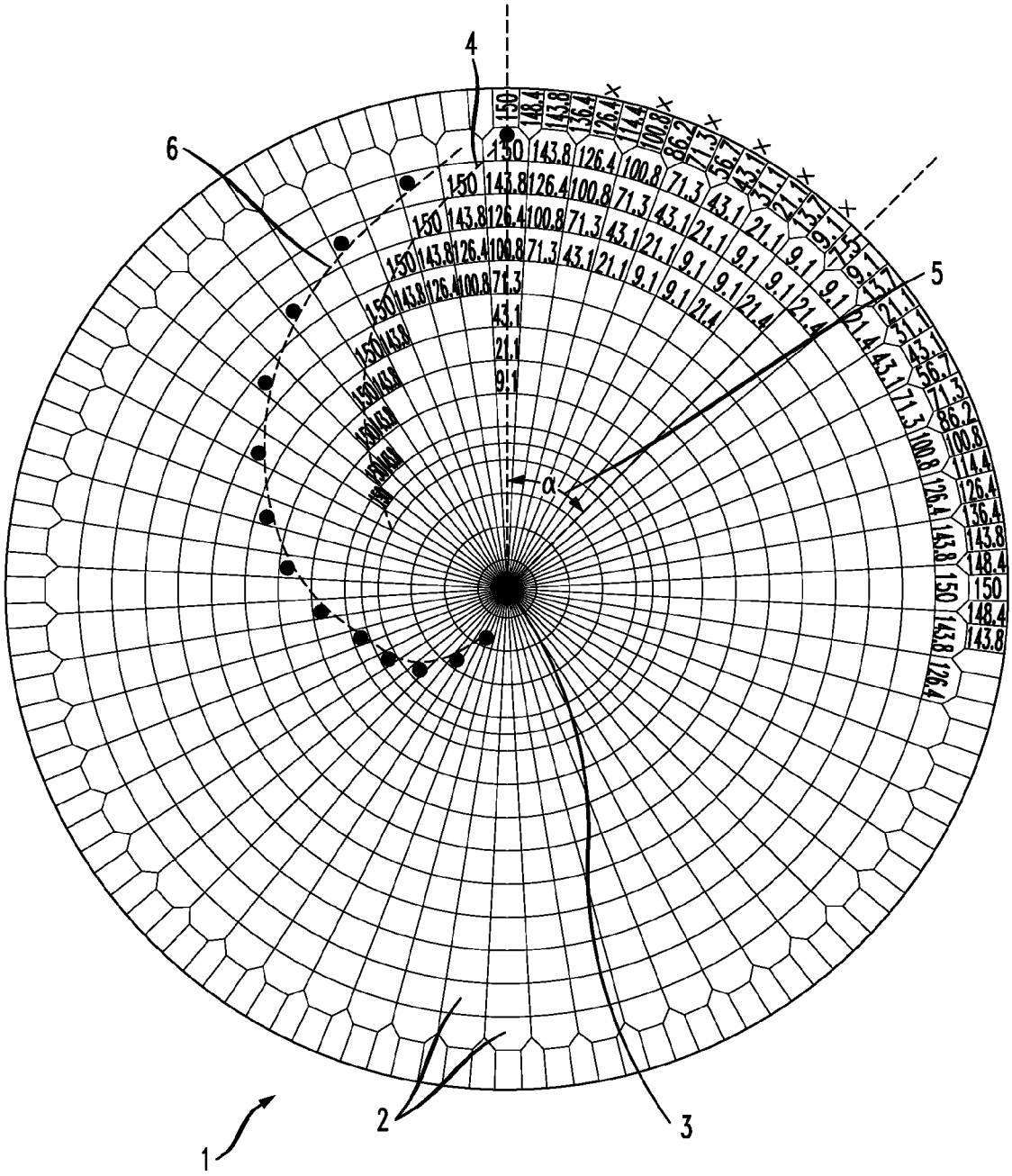
FIG. 1 is a schematic of an exemplary embodiment of an inventive faceted reflector in plan view.

With reference to FIG. 1, the aim is to explain the essential features of a reflector 1 in more detail.

The reflector 1 is illustrated in plan view. What is involved is a faceted reflector that has a multiplicity of facets 2. The facets 2, which are designed as cylindrical facets (not illustrated), run substantially in columns that point radially to the midpoint 3 of the reflector. At the same time, the facets 2 form circular columns that run around the reflector. The reflector thus has approximately 15 rows that respectively have approximately 30 facets.

The facets 2 are designed as cylindrical facets in such a way that the shape of the respective facet 2 is defined by a circular cylinder whose axis of rotation runs substantially along the inner surface of the reflector. The respective facets are formed by the cut surfaces of these individual cylindrical sections.

The radius of these cylindrical facets, and thus the radius of curvature of the facets 2, assumes values between 9.1 and 150 mm.

Thus, the uppermost facet row begins with a radius of curvature of 150 mm at 0° position. At an angle á 5 of 45°, the radius of curvature decreases to 9.1 mm and then rises again to 150 mm, as a result of which the second maximum in the radius of curvature is reached at 90°. In this case, the radii of curvature substantially follow a sinusoidal curve. Thus, the maximum radii of curvature of the outer facet row lie at 0°, 90°, 180° and 270°, whereas the minimum radii of curvature of the facets lie at 45°, 135°, 225° and 315°.

Seen from an arbitrary reference facet, the facet of the subsequent column is displaced in each case by one field in the clockwise sense.

The facets 2 with respectively identical radius of curvature are therefore arranged spirally, as is indicated by the dashed line 4.

The black points along the dashed line 6 are intended to describe another embodiment of a reflector 2. In this case, starting from the midpoint 3 the facet with an identical radius of curvature in the subsequent row is displaced by two fields in the manner of a knight's move. The spiral configuration in accordance with the dashed line 6 therefore has a lesser gradient than that in accordance with the dashed line 4.

The reflector 1 is constructed from glass and provided with a reflecting coating. It is, in particular, provided to apply a cold light mirror coating.

A cutout (not illustrated) for introducing a luminous means (not illustrated) is arranged substantially at the midpoint 3 of the rotating symmetrical reflector. The luminous means is designed as a high pressure discharge lamp, preferably as a metal-halide lamp with ceramic burner. The inventive reflector can be used to attain a light field that is distinguished both by a high color homogeneity and by a high homogeneity in the illuminance.

Figure 2:
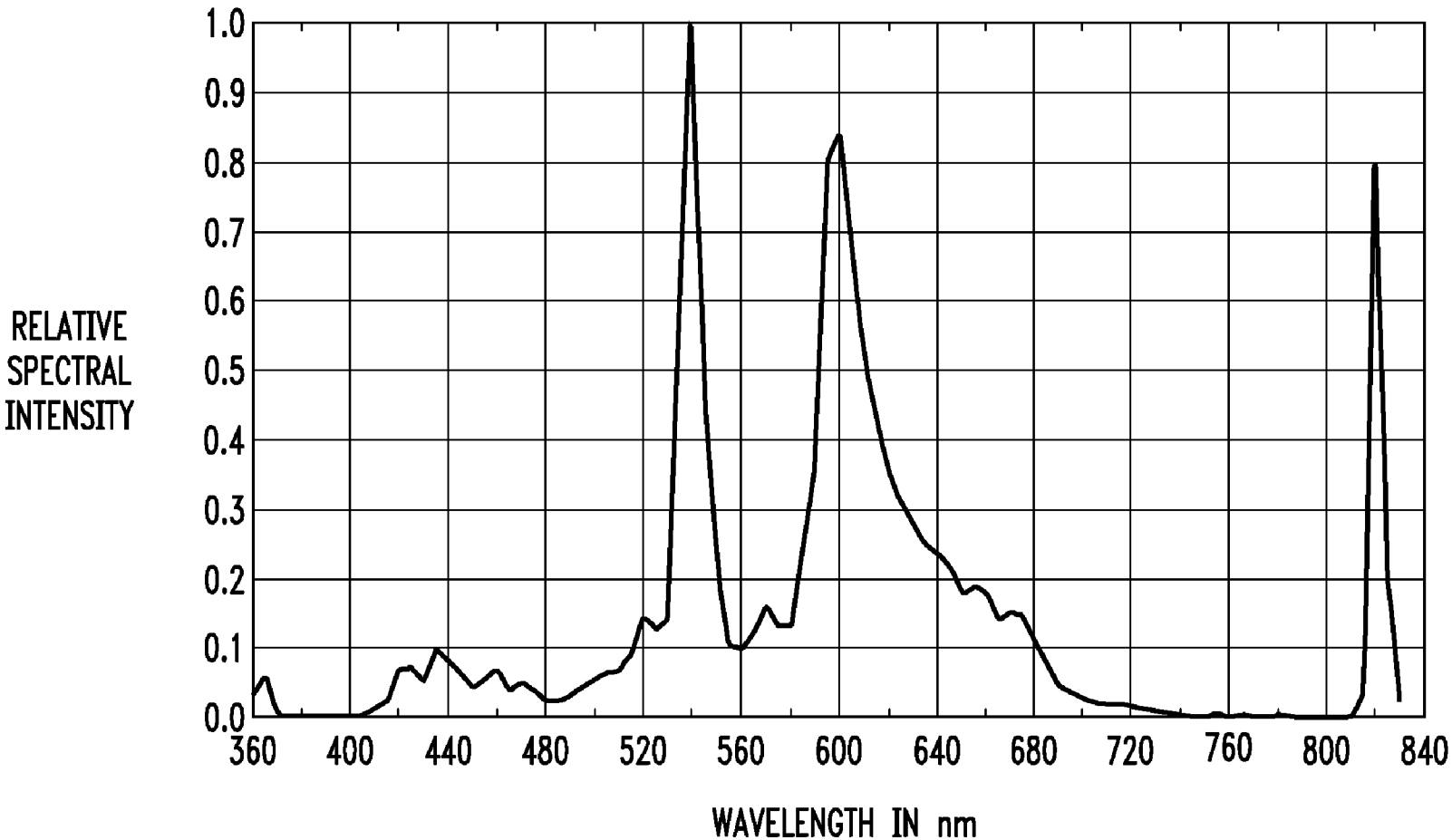
FIG. 2 shows the emission spectrum of a gas discharge lamp in an upper region.
Figure 3:
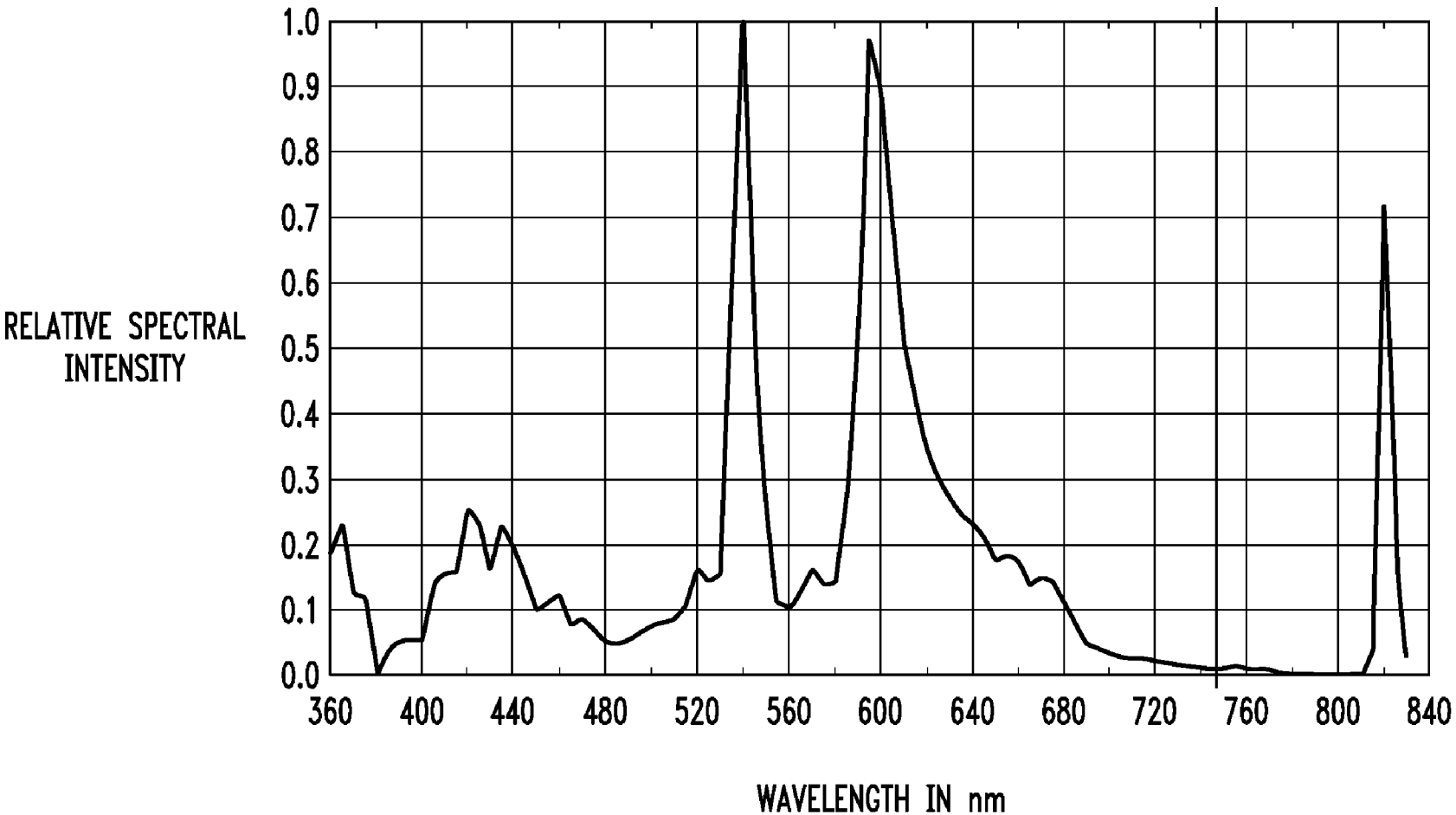
FIG. 3 shows the emission spectrum of a gas discharge lamp in a lower region.

Referring to FIG. 2 and FIG. 3, the aim is to explain the inhomogeneous emission behavior of a gas discharge lamp in more detail.

FIG. 2 shows the emission spectrum of a gas discharge lamp in an upper region. In this case, the emission of the gas discharge lamp was measured substantially from above. The measurement therefore primarily reproduces the emission components of the upper region.

It goes without saying that the definition of above and below is arbitrary; in particular, it is possible to interchange above and below.

The wavelength is plotted in nm on the x-axis, and the relative spectral intensity is plotted on the y-axis.

The measurement yields a color temperature of approximately 2830 K.

FIG. 3 shows the emission spectrum of a gas discharge lamp in a lower region. The emission of the gas discharge lamp was measured in this case substantially at an angle of 45° from below. The measurement therefore primarily reproduces the emission components of the lower region.

It is to be seen that the relative spectral intensity does not correspond to the measurement from FIG. 2. Thus, a color temperature of approximately 2980 K is also measured.

The different spectral distributions lead to color differences in the emitted light field. Such color differences can be reduced or even largely avoided with the aid of an inventive reflector.

It goes without saying that the invention is not limited to a combination of previously described features, but that the person skilled in the art will combine all the features to the extent that is sensible.

The invention claimed is:

1. A reflector for holding a luminous means, the reflector having facets that are arranged substantially in columns, which point radially to a midpoint and simultaneously form rows running substantially circularly or elliptically about the midpoint, wherein at least two facets of the reflector are designed in such a way that they direct light from a lower and an upper region of the emission region of the luminous means substantially in the same direction, and wherein light emitted by the lower region of the luminous means and light emitted by the upper region of the luminous means are of different colors with respect to each other, and wherein a substantially identically configured facet is respectively arranged in a fashion offset by at least one field on at least 5 consecutive rows or columns.

2. The reflector as claimed in claim 1, wherein the lower emission region is spaced apart from the upper emission region by at least 0.2 mm.

3. The reflector as claimed in claim 1, wherein the identically configured facet is arranged offset by two fields in the manner of two units ahead and one unit sideways.

4. The reflector as claimed in claim 1, wherein the identically configured facet is arranged offset by at least 3 fields.

5. The reflector as claimed in claim 1, wherein identically configured offset facets run from a first row, near the midpoint, up to a second row, substantially on the edge side.

6. The reflector as claimed in claim 1, wherein the identically configured facets are facets with a substantially identical radius of curvature.

7. The reflector as claimed in claim 1, wherein the reflector is of substantially rotationally symmetrical design.

8. The reflector as claimed in claim 1, wherein the facets at least partially have a shape that corresponds substantially to a section of a circular cylinder, that is to say cylindrical facets are involved.

9. The reflector as claimed in claim 1, wherein the facets are at least partially configured in a spherical fashion or as cylindrical facets, the radius of the basic body of the facets lying between 5 mm and 200 mm.

10. The reflector as claimed in claim 1, wherein the reflector has cylindrical facets or spherical facets, of which there are facets that have a basic body whose radius is at least 3 times as large as the radius of other smaller facets.

11. The reflector as claimed in claim 10, wherein the facets are arranged in a row.

12. The reflector as claimed in claim 1, wherein the number of the facets on a row is substantially constant.

13. The reflector as claimed in claim 1, wherein the facets are configured as cylindrical facets, and the axis of rotation points substantially respectively in the direction of a midpoint of the reflector or is aligned perpendicular to the direction of the midpoint.

14. The reflector as claimed in claim 1, wherein the reflector has between 5 and 30 rows.

15. The reflector as claimed in claim 1, wherein the reflector has between 20 and 150 columns.

16. The reflector as claimed in claim 1, wherein the radius of the facets within at least one row decreases or increases from field to field up to a specific angle.

17. The reflector as claimed in claim 16, wherein the angle is approximately 45° or 90°.

18. The reflector as claimed in claim 16, wherein the increase or decrease in the radius substantially obeys a sinusoidal function.

19. The reflector as claimed in claim 16, wherein the radius of the facets increases and decreases periodically over 360°.

20. The reflector as claimed in claim 1, having facets that are arranged substantially in columns, which point radially to a midpoint and simultaneously form rows running substantially circularly or elliptically about a midpoint, wherein a substantially identically configured facet is respectively arranged, at least partially in the neighboring row and/or column, in a fashion offset by at least one field.

21. A luminaire comprising a reflector as claimed in claim 1 and at least one luminous means.

22. The luminaire as claimed in claim 21, wherein the light of various emission sites of the luminous means is at least partially superposed on the light field of the luminaire.

23. The luminaire as claimed in claim 22, wherein the light of an emission site that is substantially located in a front region of the luminous means is partially superposed by the light of an emission site that is substantially located in a rear region of the luminaire on the light field of the luminaire.

24. The luminaire as claimed in claim 21, wherein the luminous means is designed as a gas discharge lamp.

25. The luminaire as claimed in claim 21, wherein the color temperature of the luminaire lies between 2800 and 4500 K.

26. The luminaire as claimed in claim 21, wherein the luminaire has a diffuser.

27. The luminaire as claimed in claim 21, wherein the light source is over 2 cm long.

28. A reflector for holding a luminous means, the reflector having facets, wherein at least two facets of the reflector are designed in such a way that they direct light from a lower and an upper region of the emission region of the luminous means substantially in the same direction and wherein light emitted by the lower region of the luminous means and light emitted by the upper region of the luminous means are of different colors with respect to each other, and wherein the reflector has cylindrical facets, cylindrical facets with at least two different radii being provided, and cylindrical facets with various radii being irregularly distributed.

* * * * *